US012742339B2

(12) United States Patent
Thiem et al.

(10) Patent No.: US 12,742,339 B2
(45) Date of Patent: Sep. 22, 2026

(54) FENCE POST SYSTEMS AND METHODS

(71) Applicants: Wayne R. Thiem, Bozeman, MT (US); Talon J. Schneiter, Bozeman, MT (US)

(72) Inventors: Wayne R. Thiem, Bozeman, MT (US); Talon J. Schneiter, Bozeman, MT (US)

( * ) Notice: Subject to any disclaimer, the term of this patent is extended or adjusted under 35 U.S.C. 154(b) by 246 days.

(21) Appl. No.: 18/428,255

(22) Filed: Jan. 31, 2024

(65) Prior Publication Data

US 2024/0271459 A1 Aug. 15, 2024

Related U.S. Application Data

(60) Provisional application No. 63/445,195, filed on Feb. 13, 2023.

(51) Int. Cl.
*E04H 17/12* (2006.01)
*E04H 17/10* (2006.01)

(52) U.S. Cl.
CPC ..... *E04H 17/12* (2013.01); *E04H 17/124* (2021.01)

(58) Field of Classification Search
CPC ..... E04H 17/12; E04H 17/124; A01G 17/06
See application file for complete search history.

(56) References Cited

U.S. PATENT DOCUMENTS 204,275 A * 5/1878 Allen ..... E04H 17/124 256/48
206,078 A * 7/1878 Bowes ..... E04H 12/2223 52/157
216,037 A * 6/1879 Hayne ..... E04H 17/124 256/DIG. 5
242,725 A * 6/1881 Wesson ..... E04H 17/12 256/58
257,599 A * 5/1882 Lucas ..... E04H 17/12 52/156
394,973 A * 12/1888 Grove ..... E04H 17/12 256/52
432,930 A * 7/1890 Bond ..... E04H 17/12 256/48

(Continued)

OTHER PUBLICATIONS

"Rolled Edge Notched Post," Quiedan Company, 2013, 1 page.

(Continued)

*Primary Examiner* — Daniel J Wiley
(74) *Attorney, Agent, or Firm* — Sheridan Ross P.C.

(57) ABSTRACT

Fence posts for constructing a wire fence, fence stays, and methods for constructing a wire fence are provided. The fence posts include a stem portion having a front edge and a rear portion or flange. Receiving apertures are disposed in the stem portion of each fence post. The receiving apertures each include a slot portion and a retaining portion. The slot portion can taper from a relatively wide opening along the front edge of the fence post to a relatively narrow portion at an intersection between the slot portion and the retaining portion. The retaining portion is formed as an arc centered on the slot portion. The fence posts additionally include a base portion configured to be received in the ground. Fence stays, configured with receiving apertures like those of the fence posts, but without base portions, are also provided.

20 Claims, 8 Drawing Sheets

(56) References Cited

U.S. PATENT DOCUMENTS 500,392 A * 6/1893 Hunt et al. ..... E04H 17/12 256/58
563,842 A * 7/1896 Chance ..... E04H 17/12 52/630
565,966 A * 8/1896 Deck ..... F16G 11/12 256/37
578,076 A * 3/1897 Brown ..... E04H 17/12 256/58
636,719 A * 11/1899 Conroy et al. ..... E04H 17/12 256/65.02
636,855 A * 11/1899 Sawyer ..... E04H 17/12 256/65.02
657,145 A * 9/1900 Wiggins ..... E04H 17/12 256/2
733,906 A * 7/1903 Froggatt ..... E04H 17/12 256/48
772,614 A * 10/1904 Hannon ..... E04H 17/12 256/54
779,057 A * 1/1905 Turner ..... E04H 17/12 256/65.02
785,259 A * 3/1905 Lieser ..... E04H 17/12 256/52
798,946 A * 9/1905 Blackburn ..... E04H 17/12 52/146
807,414 A * 12/1905 Bernston ..... E04H 17/12 256/56
820,171 A * 5/1906 Barnes ..... E04H 17/12 52/630
832,618 A * 10/1906 McNally ..... E04H 17/124 256/57
851,445 A * 4/1907 Seymour ..... E04H 17/08 256/48
867,037 A * 9/1907 Hargis ..... E04H 17/124 256/57
874,420 A * 12/1907 McKenzie ..... E04H 17/12 174/146
1,050,589 A * 1/1913 Young ..... E04H 17/124 256/48
1,063,142 A * 5/1913 Tobias ..... E04H 17/12 256/58
1,117,214 A * 11/1914 McFarland et al. .... E04H 17/12 256/53
1,188,958 A * 6/1916 Ludwick ..... E04H 17/124 256/48
1,202,694 A * 10/1916 Fellows ..... E04H 17/124 256/52
1,264,624 A * 4/1918 Ephraim ..... E04H 17/12 256/52
1,267,568 A * 5/1918 McAlister ..... E04H 17/124 256/52
1,356,970 A * 10/1920 Clum ..... E04H 17/12 256/58
1,399,426 A * 12/1921 Harding ..... E04H 17/12 52/165
1,495,379 A * 5/1924 Bumbaugh ..... E04H 17/08 256/53
1,565,339 A * 12/1925 Thompson ..... E04H 17/12 256/52
1,661,528 A * 3/1928 Dunlap ..... E04H 17/12 256/58
1,689,610 A * 10/1928 Winter ..... E04H 17/12 256/48
1,704,644 A * 3/1929 Achterkirch ..... E04H 17/12 256/52
1,786,573 A * 12/1930 Maserang ..... E04H 17/12 256/56
2,038,133 A * 4/1936 Schantz ..... E04H 17/12 256/58
2,291,430 A * 7/1942 Ingersoll ..... H01B 17/145 16/2.2
2,854,101 A * 9/1958 Carper ..... E04H 17/12 256/52
3,502,303 A * 3/1970 Bishop ..... E04H 17/12 256/48
3,776,522 A * 12/1973 Bartlett ..... E04H 17/12 256/50
4,462,572 A * 7/1984 Hanneken ..... E04H 17/12 256/49
4,738,051 A 4/1988 Dyson
5,350,155 A * 9/1994 Burk ..... E04H 17/12 256/48
5,438,795 A * 8/1995 Galbraith ..... A01G 17/06 256/48
5,899,041 A * 5/1999 Durin ..... H02G 3/263 52/662
6,138,407 A * 10/2000 Pierce, Jr. ..... A01G 17/06 47/46
6,973,751 B2 12/2005 Pierce, Jr.
7,249,439 B2 7/2007 Pierce, Jr.
8,540,217 B2 * 9/2013 Olsson ..... E04H 17/12 256/48
2005/0167644 A1 * 8/2005 Deupree ..... E04H 12/2215 256/32
2014/0145134 A1 * 5/2014 Schaeffer ..... E04H 17/12 256/35

OTHER PUBLICATIONS

"The "ARTISAN" Top Notch Post VSP Systems," Quiedan Company, 2015, 1 page.
"The Enhanced Artisan Top Notch Post VSP Systems," Quiedan Company, 2014, 1 page.
"Top Notch Stake," Quiedan Company, 2017, 1 page.
Official Action for U.S. Appl. No. 18/903,817, dated Jun. 4, 2026 11 pages.

* cited by examiner

FENCE POST SYSTEMS AND METHODS

CROSS-REFERENCE TO RELATED APPLICATIONS

This application claims the benefit of U.S. Provisional Patent Application Ser. No. 63/445,195, filed Feb. 13, 2023, the entire disclosure of which is hereby incorporated herein by reference.

FIELD

The present disclosure is directed to a fence post for use in providing a wire fence, and methods for providing a wire fence. Embodiments of the present disclosure can also include a fence stay for use between fence posts.

BACKGROUND

Wire fences, including but not limited to wire mesh, barbed wire, and plain wire fences, can provide an economical and effective fencing solution. Metal posts are often preferred for wire fences, as they can provide a more reliable, durable, and economical support structure than wood posts. Metal fence posts for use with wire fences include T-posts and U-channel posts, which typically feature metal tabs that can each receive and support a horizontally extending wire. Other examples of metal fence posts include studded T-posts, in which fence wires are held against the studs by wire clips. Still other examples include "Peach", T and Y-posts with holes or notches for receiving fence wires formed in edges or flanges. Although it is usually relatively quick and easy to attach fence wires to posts having tabs, flanges, or notches, the security of the resulting attachment is often wanting, as it is relatively easy for a fence wire to become detached from the post. Ensuring the security of the attachment between the fence wires and such posts requires separate clips. However, using clips adds to the overall cost of the fence, adds to the time required to build the fence, and can result in the need for additional crew members, as installation can be a two-person operation. Designs having holes through which the fence wires are threaded are more secure, but it is relatively difficult and time consuming to construct a fence in that manner. Accordingly, it would be desirable to provide a fence post for use with wire fences that enabled the fencing material to be quickly and easily attached to the post in a secure and economical manner.

SUMMARY

Disclosed herein are fence systems and forming methods that incorporate a fence post configured to allow for the easy and secure connection of a fence wire to the fence post. In accordance with embodiments of the present disclosure, in a top plan view, the fence post features a generally T-shaped form, with the stem portion of the T forming a stem of the fence post, and with the top or back portion of the T forming a rear flange, also referred to herein simply as a flange, of the fence post. The stem of the fence post can be configured as a separate piece of material that is joined to the rear flange, or the stem and the rear flange can be formed from a unitary piece of material. One or both of the stem and the flange of the fence post can be configured as flat, curved, or rolled members. The stem of the fence post includes a number of receiving apertures formed therein. Each receiving aperture in the stem can include a tapered slot extending from a front edge of the stem of the fence post and towards the rear flange of the fence post. The tapered slot intersects a curved retaining portion. A base portion of the fence post can include serrations in one or both of the stem and rear flange of the fence post. In addition to a fence post, a fence stay with a planar, U-shaped, or T-shaped member incorporating the same or a similar number of receiving apertures having tapered slots and curved retaining portions as formed in the fence post can be provided. Fence posts and fence stays in accordance with embodiments of the present disclosure can be formed from, for example, a metal, composite, or plastic material.

In accordance with an exemplary embodiment of the present disclosure, a wire fence using posts and stays in accordance with embodiments of the present disclosure is formed by placing fence posts in the ground at selected intervals along a fence line. Fence wire is then strung, typically starting from a first reinforced or braced corner post or from an H brace, through a number of intermediate fence posts, to a second reinforced or braced corner post or to an H brace. At least the intermediate fence posts include fence posts with receiving apertures configured as disclosed herein. The fencing wire is engaged with the receiving apertures by pushing it through the slot, and into the curved retaining portion, where the wire is retained. Fence stays with receiving apertures configured as disclosed herein can be disposed between fence posts by engaging the fencing wire with the receiving apertures formed in the fence stay by pushing it through the slot and into the curved retaining portion. Accordingly, a wire fence can be quickly and securely constructed.

Additional features and advantages of embodiments of the present disclosure will become more readily apparent from the following description, particularly when understood in view of the accompanying drawings.

DETAILED DESCRIPTION

Figure 1:
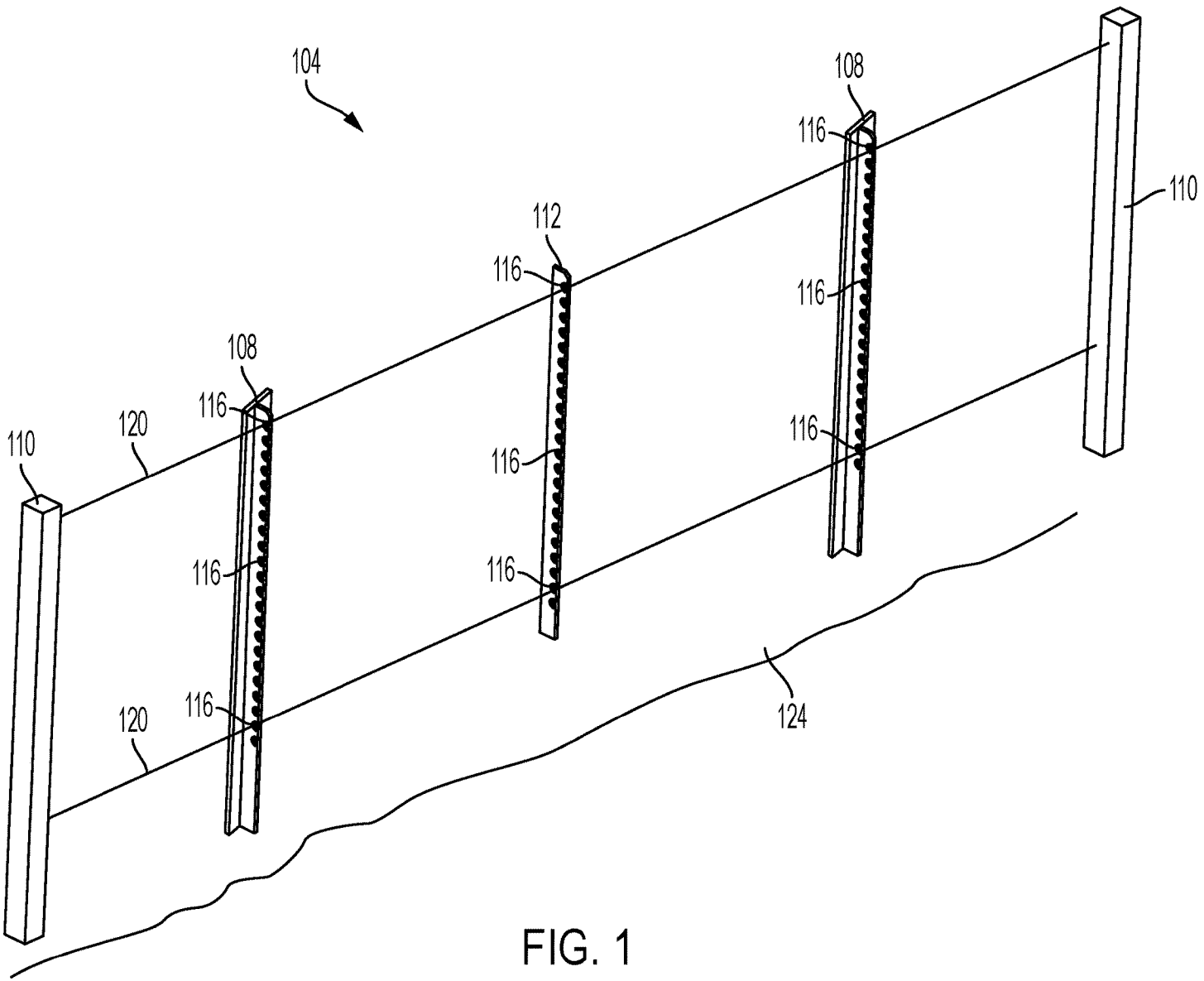
FIG. 1 is a view of a wire fence constructed using fence posts and stays in accordance with embodiments of the present disclosure.

With reference to FIG. 1, a wire fence 104 constructed using fence posts 108 and fence stays 112 in accordance with embodiments of the present disclosure is depicted. The fence 104 includes corner posts, H-braces, or the like, hereinafter referred to herein as simply braces 110, between which one or more wires 120 are strung. As described in greater detail elsewhere herein, the fence posts 108 and fence stays 112 include receiving apertures 116 for receiving wires 120 of the wire fence 104. The fence posts 108 are secured in the ground 124, for example by pounding base portions of the fence posts 108 into the earth. The fence stays 112 are typically suspended above the ground 124 by the wires 120. In accordance with embodiments of the present disclosure, the wires 120 can be barbed or unbarbed. Although only two fence posts 108 and one fence stay 112 is illustrated between the braces 110, it should be appreciated that the number of fence posts 108 and the number of fence stays 112 between a pair of braces 110 are not limited to any particular number.

Figure 2:
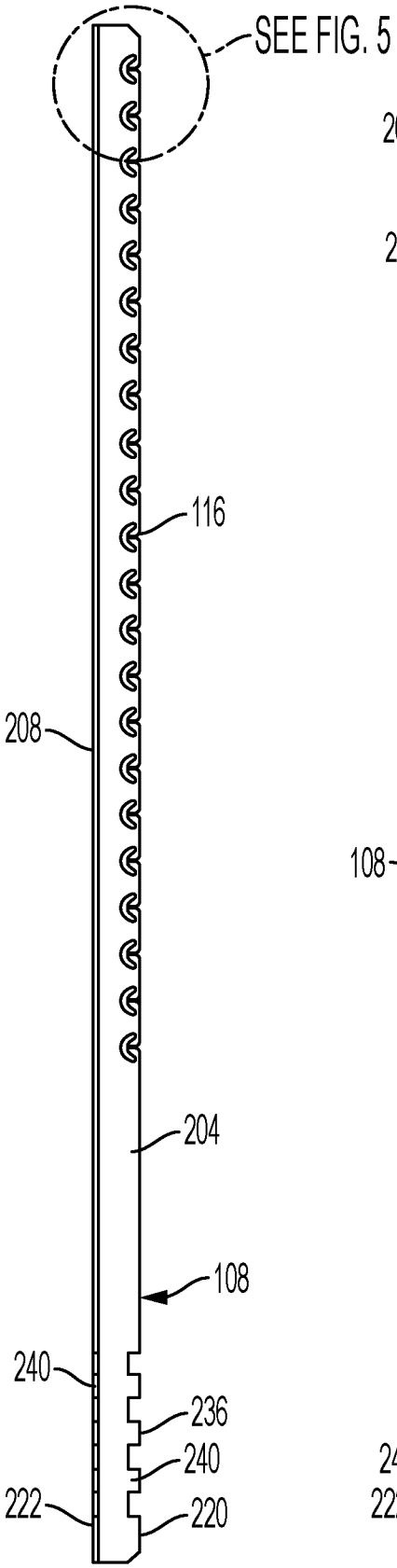
FIG. 2 is a side view in elevation of a fence post in accordance with embodiments of the present disclosure.
Figure 3:
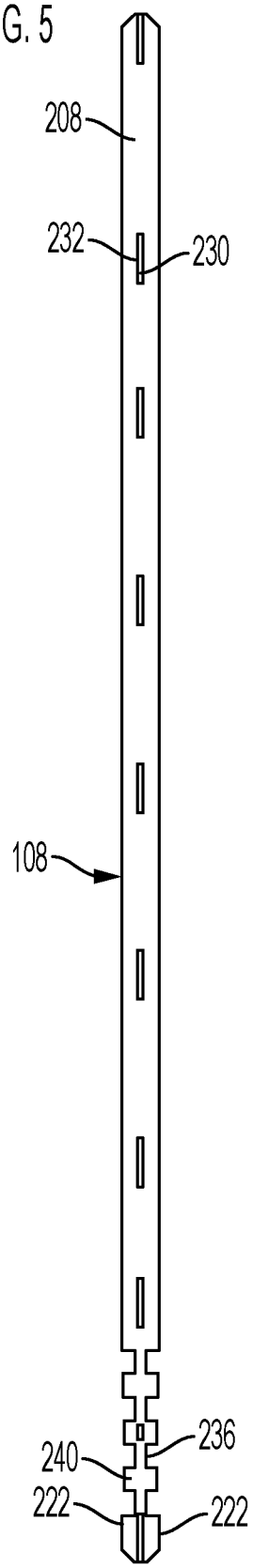
FIG. 3 is a rear view in elevation of the fence post of FIG. 2.
Figure 4:
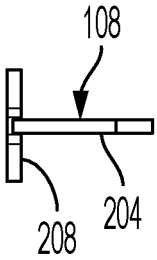
FIG. 4 is a top plan view of the fence post of FIG. 2.

FIG. 2 is a side view in elevation of a fence post 108 in accordance with at least some embodiments of the present disclosure; FIG. 3 is a rear view in elevation of a fence post 108 in accordance with embodiments of the present disclosure; and FIG. 4 is a top plan view of a fence post 108 in accordance with embodiments of the present disclosure. As shown, the fence post 108 can be generally T-shaped in top plan view, with a front facing stem portion 204 disposed in first plane and a rear flange portion 208 across a rear edge of the stem portion 204 and disposed in a second plane that is perpendicular to the first plane. Receiving apertures 116 are formed at intervals along the stem portion 204. In accordance with at least some embodiments of the present disclosure, the receiving apertures 116 can be formed at intervals corresponding to typical spacing between horizontal wires in wire mesh fencing material, enabling use of the fence posts 108 and fence stays 112 with such materials, in addition or as an alternative to barbed or un-barbed wire fencing material. As an example, but without limitation, the receiving apertures 116 can be disposed at 2 inch intervals over all or a majority of the length of the fence post 108 or fence stay 112.

The stem portion 204 of the fence post 108 can be joined to the rear flange portion 208, thereby providing a reinforced structure. A series of tabs 230 in a rear edge of the stem portion 204 and corresponding slots 232 formed in the rear flange portion 208 (see FIG. 3) can be provided to reinforce the connection between the stem portion 204 and the rear flange portion 208. Whether or not tabs 230 and slots 232 are provided, the stem portion 204 and the rear flange portion 208 can be welded glued, fused, or otherwise interconnected to one another. Alternatively or in addition, the rear flange portion 208 can include a channel that partially receives the stem portion 204, as shown in FIG. 4. A base portion 236 of the fence post 108 can include teeth or serrations 240 in the front edge 220 of the stem portion 204, in the side edges 222 of the rear flange portion 208, or in both the front edge 220 of the stem portion 204 and the side edges 222 of the rear flange portion 208.

Figure 5:
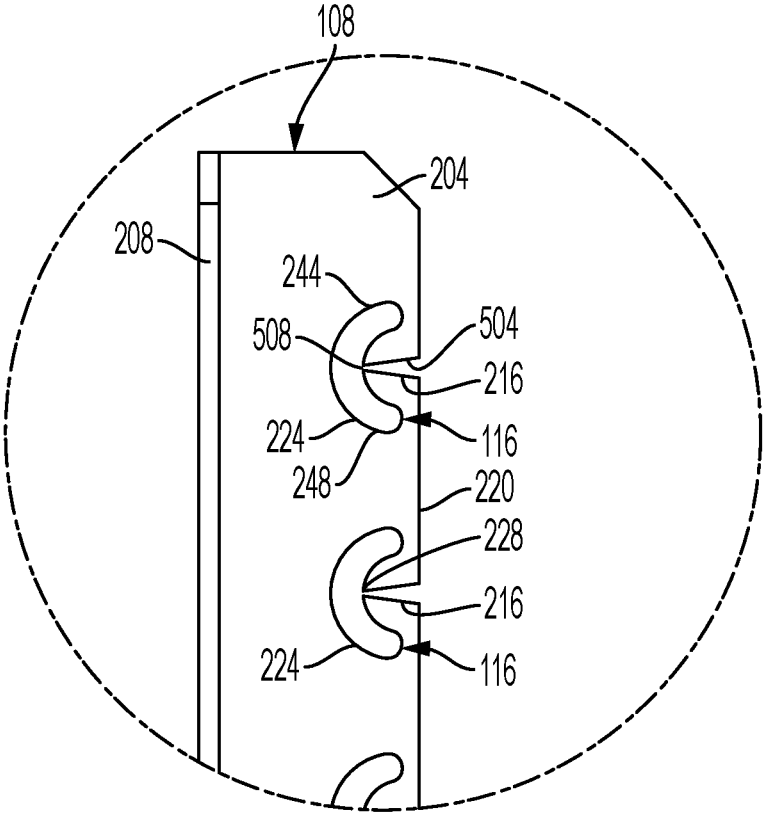
FIG. 5 is a view of a portion of the fence post of FIG. 2 in a side view in elevation, illustrating features of receiving apertures in accordance with embodiments of the present disclosure.
Figure 6:
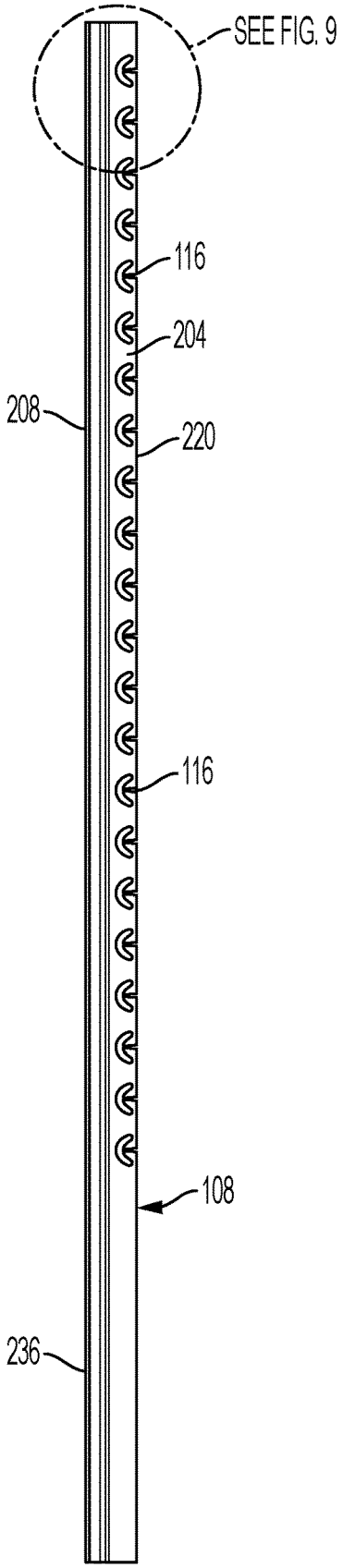
FIG. 6 is a side view in elevation of a fence post in accordance with other embodiments of the present disclosure.
Figure 7:
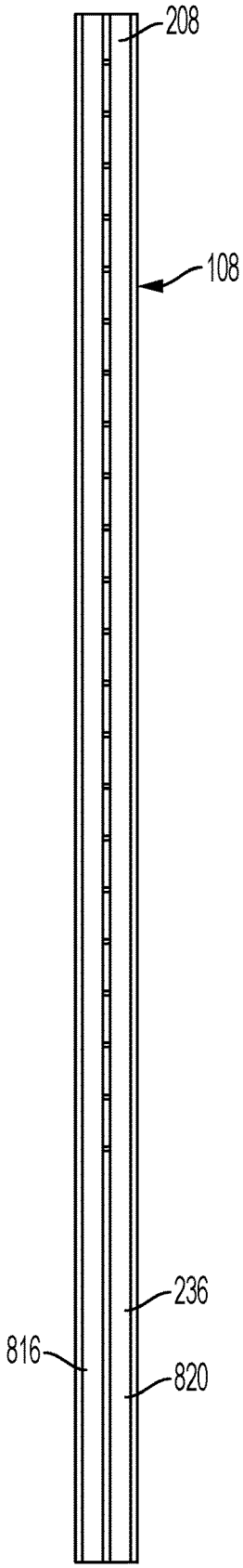
FIG. 7 is a rear view in elevation of the fence post of FIG. 6.

With reference now to FIG. 5, which presents a detailed view of a portion of a fence post 108 in accordance with embodiments of the present disclosure in a side view in elevation, the receiving apertures 116 can be seen to include a slot portion 216 that extends from the front edge 220 of the stem portion 204 toward the rear flange portion 208. The slot portion 216 of each receiving aperture 116 terminates at a retaining portion 224. In accordance with the least some embodiments of the present disclosure, the slot portion 216 can be tapered. For example, when considered in a side elevation view, the slot portion 216 can gradually narrow, from a wider opening section 504 disposed along the front edge 220 of the fence post 108 to a narrower end section 508 at an intersection 228 between the slot portion 216 and the retaining portion 224. Accordingly, the slot portion 216 and the retaining portion 224 are in communication with one another. As an example, a distance between opposing sides of the slot portion 216 at the opening section 504 can be multiple times (e.g. 3 or 4 times) a diameter of a fence wire 120 intended for use with the fence post 108, while the distance between the opposing sides of the slot portion 216 at the end section 508 of the slot portion 216 immediately adjacent to the retaining portion 224 can be the same as or slightly larger than the diameter of the fence wire 120. The retaining portion 224 of each receiving aperture 116 can include an upper portion 244 and a lower portion 248 that each extend from an area of intersection between the slot portion 216 and the retaining portion 224. In accordance with at least some embodiments of the present disclosure, the upper 244 and lower 248 portions of the retaining portion 224 can be of equal length, and thus the retaining portion 224 can be centered relative to the slot portion 216. In accordance with further embodiments of the present disclosure, the retaining portion 224 can be configured as an arc that is centered on the end section 508 of the corresponding slot portion 216, and that curves from the intersection 228 with the end section 508 of the slot portion 216, back towards the front edge 220 of the fence post 108. Alternative configurations of receiving apertures 116 are possible. For example, instead of arced upper 244 and lower 248 portions, the retaining portion 224 can include upper 244 and lower 248 portions configured as a pair of linear arms that extend from the intersection 228 with the slot portion 216, and back towards the front edge 220 of the fence post. As yet another example, the upper 244 and lower 248 portions can extend from the intersection 228 with the slot portion 216 and towards the rear flange portion 208. In accordance with embodiments of the present disclosure, a width of the retaining portion 224 is greater than a diameter of the fence wire 120.

Figure 8:
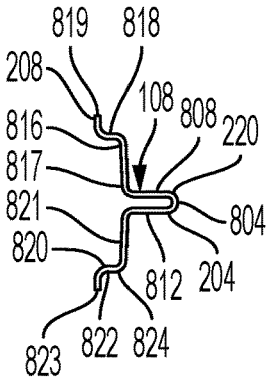
FIG. 8 is a top plan view of the fence post of FIG. 6.
Figure 9:
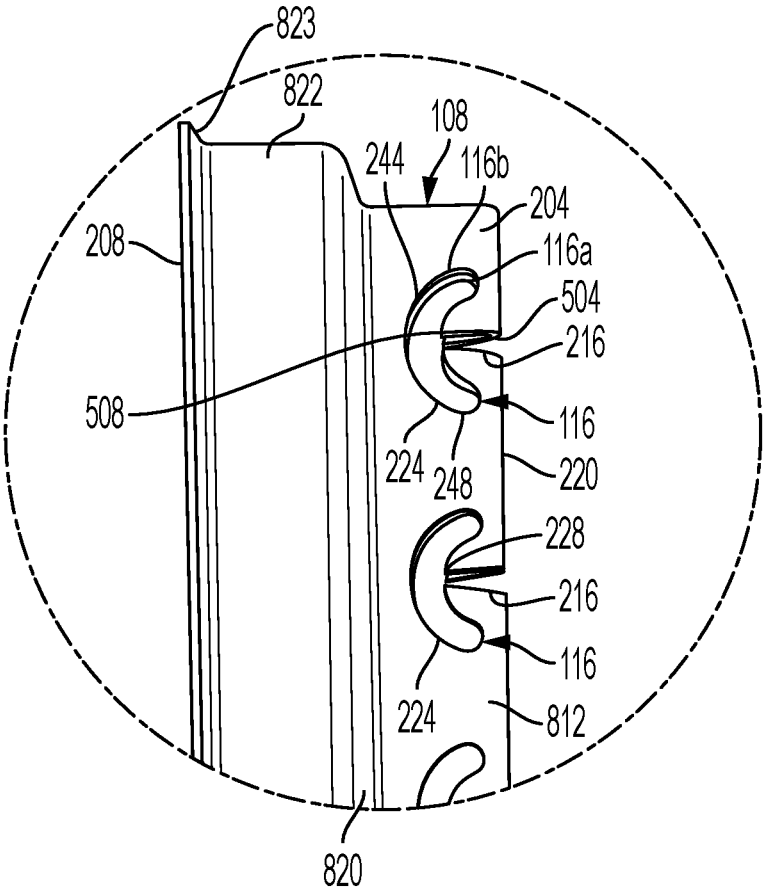
FIG. 9 is a view of a portion of the fence post of FIG. 6 in a side view elevation, illustrating features of receiving apertures in accordance with other embodiments of the present disclosure.
Figure 10:
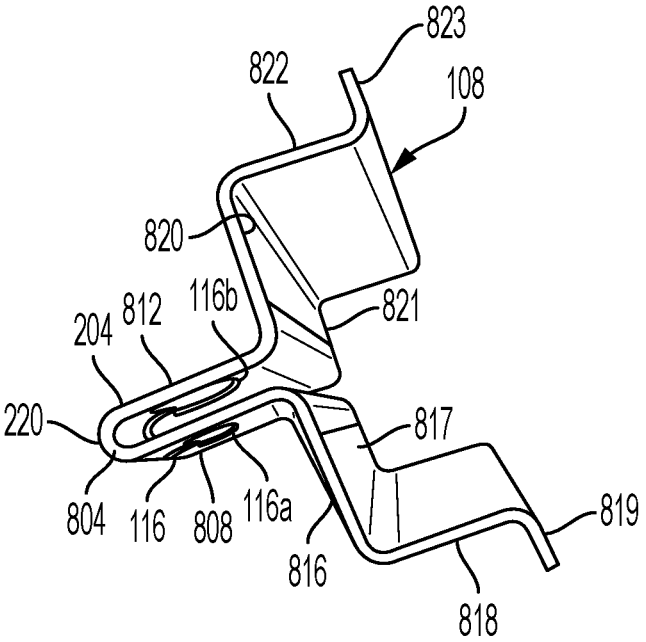
FIG. 10 is a perspective view of the fence post of FIG. 6.

In accordance with at least some embodiments of the present disclosure, a fence post 108 can be formed from a unitary piece of material, rather than from separate pieces that are joined to one another. A fence post 108 formed from a unitary piece of material can be configured as or similarly to the embodiment depicted in FIGS. 2-5, for instance where the fence post 108 is formed from a polymer. Alternatively, and with reference now to FIGS. 6-12, a fence post 108 in accordance with embodiments of the present disclosure can be formed from a single piece of material, for example steel, that begins as a flat sheet and that is rolled or bent to form a stem portion 204 and a rear flange portion 208. As best shown in FIGS. 8 and 10, the front edge 220 of the stem portion 204, can correspond to a fold line 804 along a centerline of the fence post 108, with receiving apertures 116 formed in opposing first 808 and second 812 sides or portions of the stem portion 204. The first 808 and second 812 sides of the stem portion 204 extend from the fold line 804 along the front edge 220 of the fence post 108, to the rear flange portion 208. In accordance with embodiments of the present disclosure, the front edge 220 and the centerline of the fence post 108 in a plan view can be coincident with one another. Moreover, the first 808 and second 812 sides of the stem portion 204 can be parallel or nearly parallel (e.g. within +/−15 degrees) to one another. As shown in FIGS. 8 and 10, the first 808 and second 812 sides of the stem portion 204 can be spaced apart from one another. Alternatively, the first 804 and second 808 sides of the stem portion 204 can be in contact with one another. The rear flange 208 in such embodiments includes a first side or portion 816 that extends from the first side or portion 808 of the stem portion 204, and a second side or portion 820 that extends from the second side or portion 812 of the stem portion 204. In addition, the rear flange portion 208 can feature contours 824 and surfaces that serve to stiffen the fence post 108. Note that embodiments of the present disclosure encompass fence posts 108 in which the proportions of the various elements can differ. For instance, the first 816 and second 820 sides or portions can include lateral sections 817 and 821 that are larger than associated depth portions 818 and 822 and that have relatively small terminal portions 819 and 823 (see FIG. 8), or lateral portions 817 and 821 that are smaller than associated depth portions 818 and 822 and that have relatively larger terminal portions 819 and 823 (see FIGS. 9 and 10). In at least some implementations, the proportions illustrated in FIGS. 9 and 10 can provide advantages strength and stiffness characteristics.

As in other embodiments, the receiving apertures 116 can be formed at intervals in the fence post 108. Moreover, considered in profile, the receiving apertures 116 can be configured in the same or a similar way as in other embodiments. Accordingly, each of the receiving apertures 116 includes a slot portion 216 that extends from the front edge 220 of the fence post 108 to a retaining portion 224 of the receiving aperture 116. Moreover, the slot portion 216 can narrow with increasing distance from the front edge 220 of the fence post 108. In addition, the retaining portion 224 can extend from either side from an intersection between the retaining portion 224 and the slot portion 216. The retaining portion 224 can be arced, or can extend linearly from the intersection with the slot portion 216, and generally bends or extends back towards the front edge 220 of the fence post 108. However, where the fence post 108 is formed from a single rolled or bent piece of material, the receiving apertures 116 each include a first half or element 116*a* formed in the first side 808 of the stem portion 204, and a second half or element 116*b* formed in the second side 812 of the stem portion 204 (see FIG. 10). The slot portions 216 of the first 116*a* and second 116*b* halves of any one receiving aperture 116 meet at the front edge 220 of the fence post 108. In addition, the first half 116*a* of any one receiving aperture 116 is disposed immediately adjacent the second half 116*b* of that one receiving aperture 116, such that, considered in a side elevation view, the halves 116*a* and 116*b* are aligned with one another, and effectively present a single receiving aperture 116 to a fence wire 120.

Figure 12:
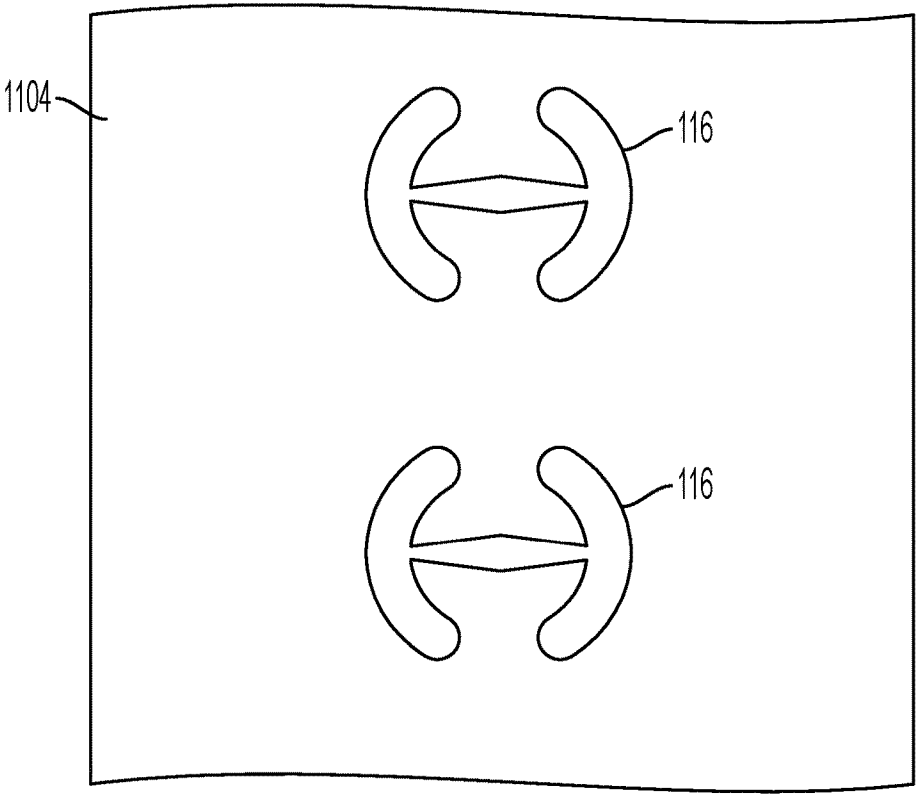
FIG. 12 is a detail of a portion of the fence post blank of FIG. 11.
Figure 11:
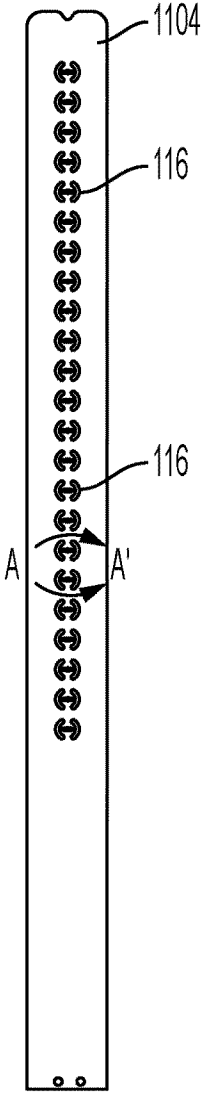
FIG. 11 is a front view in elevation of a fence post blank for forming a fence post as illustrated in FIG. 6.

A blank 1104, prior to being rolled into a final shape of the fence post 108, is illustrated in a front side elevation view in FIG. 11. A partial section of the blank 1104, encompassing two of the receiving apertures 116 formed therein, is illustrated in FIG. 12. As can be appreciated by one of skill in the art after consideration of the present disclosure, after the blank 1104 has been rolled into the cross-sectional shape of the completed fence post 108, the two sides or halves of each of the apertures 116 are aligned with one another.

Figure 13:
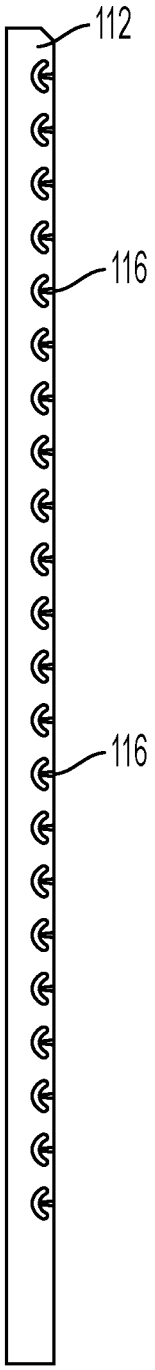
FIG. 13 is a side view in elevation of a fence stay in accordance with embodiments of the present disclosure.

With reference now to FIG. 13, a fence stay 112 in accordance with the least some embodiments of the present disclosure can be configured as a member having an overall length that is less than an overall length of a fence post 108, and in which a number of receiving apertures 116 are provided. For use as part of a particular fence 104, the number of receiving apertures 116 and the spacing between the receiving apertures 116 along the length of the fence stay 112 can be the same as the number and the spacing of the receiving apertures 116 in the fence posts 108 used in that fence 104. Moreover, the receiving apertures 116 can include slot portions 216 and curved retaining portions 224 that are the same as or similar to the receiving apertures 116 of the fence posts 108. A fence stay 112 can be configured to have the same or a similar shape in cross-section as a fence post 108. Alternatively, a fence stay 112 can differ from the fence posts 108 in that the fence stay 112 can have a different shape in cross-section from a fence post 108. For example, a fence stay 112 may include only a flat or rolled stem portion 204, without a separate or integrated flange portion 208. In addition, the fence stay 112 differs from the fence post 108 in that it does not include a base portion 236.

Figure 14:
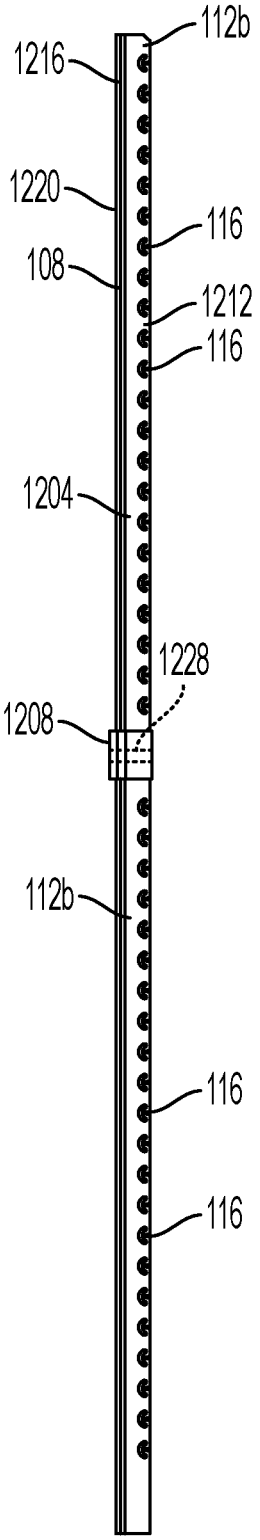
FIG. 14 is a side view in elevation of a fence stay assembly in accordance with embodiments of the present disclosure.
Figure 15:
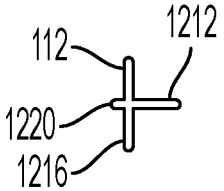
FIG. 15 is a top plan view of a fence stay of the fence stay assembly of FIG. 14.
Figure 16:
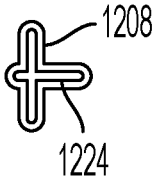
FIG. 16 is a top plan view of a fence stay connector of the fence assembly of FIG. 12.

With reference now to FIGS. 14-16, a fence stay 112 in accordance with further embodiments of the present disclosure can be provided as part of a fence stay assembly 1204 in which two or more fence stays 112*a* and 112*b* are interconnected, to increase the effective length of the fence stay 112. In such an embodiment, the fence stays 112*a* and 112*b* can be joined to one another by a collar or connector 1208. In addition, a fence stay 112 in accordance with such further embodiments can include a stem portion 1212, a rear flange portion 1216, and a spine portion 1220 on a side of the rear flange portion 1216 opposite the stem portion 1212. In such further embodiments, the connector 1208 can include an interior aperture 1224 that is configured to receive the fence stays 1212. In addition, the connector 1208 can include an internal stop 1228 to ensure that each fence stay 112*a* and 112*b* occupies only a portion of the connector 1228. As can be appreciated by one of skill in the art after consideration of the present disclosure, by enabling two or more fence stays 112 to be joined to one another, the effective length of the fence stay 112 can be increased, to accommodate taller fences. A fence stay 112 configured as shown in FIGS. 14 and 15 can also be used singly, for example where an extended length is not required.

A fence post 108 and a fence stay 112 in accordance with embodiments of the present disclosure can be formed from various materials, including but not limited to metal, such as steel or aluminum, a composite, such as a carbon fiber composite or fiberglass, or plastic, such as high density polyethylene. In accordance with the least some embodiments of the present disclosure, a fence 104 can be built using fence posts formed from a metal, and fence stays 112 formed from a plastic. Fence posts 108 and fence stays 112 can be used in connection with plain wire, barbed wire, wire mesh, or other fencing materials.

Figure 17:
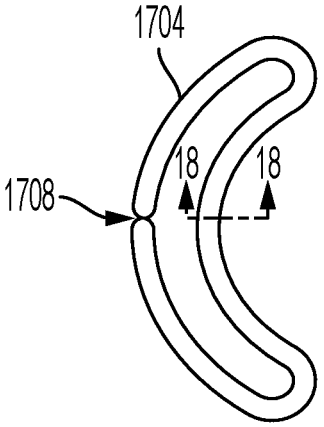
FIG. 17 is a side view in elevation of a grommet in accordance with embodiments of the present disclosure.
Figure 18:
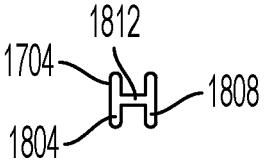
FIG. 18 is a cross-section of the grommet of FIG. 17.

With reference now to FIGS. 17 and 18, a grommet 1704 in accordance with embodiments of the present disclosure is illustrated. In general, the grommet 1704 can be used to help secure a fence wire 120 within a receiving aperture 116 of a fence post 108 or a fence stay 112. An example configuration of a grommet 1704 is shown in a side elevation view in FIG. 17. In general, the shape of the, 1704 follows or mirrors the shape of the retaining portion 224 of a receiving aperture 116. A slot 1708 is formed in the grommet 1704, to allow the grommet 1704 to be placed around a fence wire 120 after the fence wire 120 has been placed in the retaining portion 224 of a receiving aperture 116. In accordance with embodiments of the present disclosure, a location of the slot 1708 is selected so that it is not adjacent to the slot portion 216 when the grommet 1704 is installed in a receiving aperture 116. As shown in FIG. 18, with the grommet 1704 can include a first flange 1804 and a second flange 1808, joined to one another by a connecting portion 1812. When installed in a receiving aperture 116, the first flange 1804 can rest against a first side surface 808 of a fence post, while the second flange 1808 can rest against a second side surface 820 of the fence post 108 or fence stay 112. When installed, a grommet 1704 as disclosed herein can better secure a fence wire 120 within a receiving aperture 116. In addition, a grommet 1704 can insulate the fence wire 120 from the fence post 108 or fence stay 112. In accordance with embodiments of the present disclosure, the grommet 1704 can be formed from plastic, a polymer, rubber, or the like.

Figure 19:
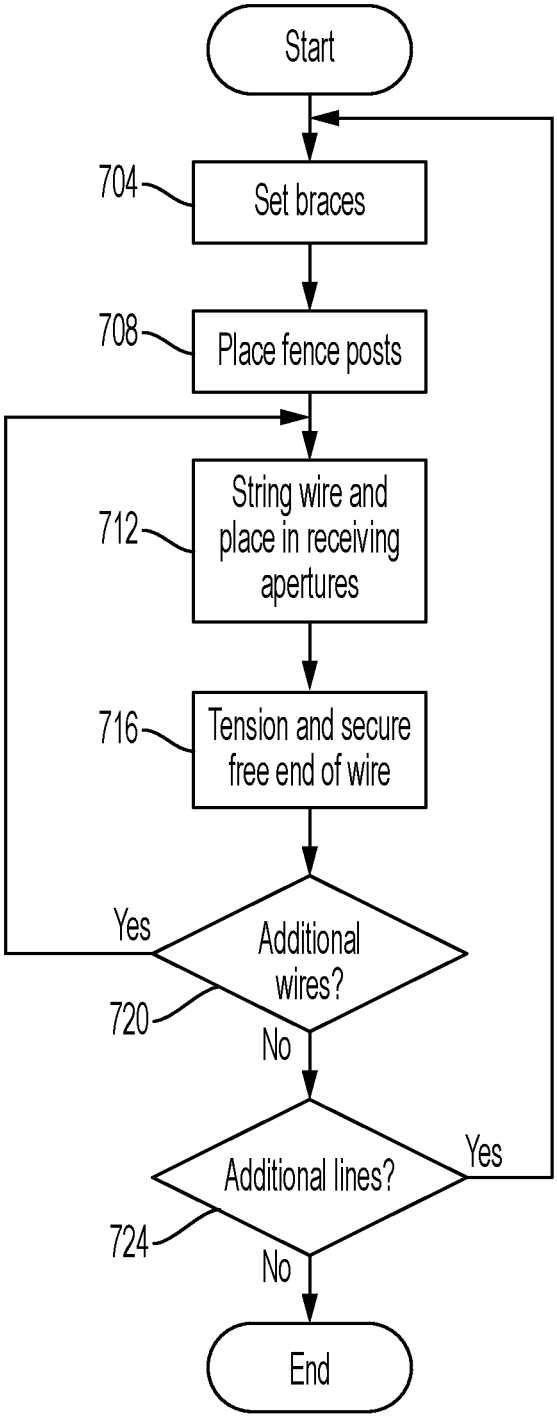
FIG. 19 is a flowchart illustrating steps of a process for constructing a wire fence in accordance with embodiments of the present disclosure.

FIG. 19 is a flowchart illustrating steps of a process for constructing a wire fence 104 in accordance with embodiments of the present disclosure. Initially, at least first and second braces 110 are set at ends of the intended fence line (step 704). Fence posts 108 configured in accordance with embodiments of the present disclosure are then placed at intervals along the intended fence line (step 708). The manner of setting the fence posts 108 can depend on the design parameters for the fence 104, the expected forces that will be placed on the fence 104, the characteristics of the ground 124, and the like. As an example, the fence posts 108 can simply be pounded into the ground 124. As another example, the fence posts 108 can be placed in holes in the ground 124 that then filled with concrete. Next, a fence wire 120 is strung from the first corner or H brace 110, and across the front edges 220 of the fence posts 108, placing the wire 120 in a receiving aperture 116 of each of the fence posts 108 (step 712). Placing the fence wire 120 in a receiving aperture 116 can include pushing the fence wire 120 into the slot portion 216, past the narrow rear portion of the slot portion 216, and back into the retaining portion 224. The particular receiving aperture 116 in which the fence wire 120 is placed can be selected based on the desired distance between the ground 124 and the fence wire 120. A desired amount of tension can then be placed on the fence wire 120, and the free end of the fence wire 120 can be secured to the second corner or H brace 110 (step 716).

At step 720, a determination can be made as to whether additional fence wires 120 are to be strung along the fence line. If one or more additional fence wires 120 are desired, the process can return to step 712, with each such additional wire 120 occupying a different receiving aperture 116 of any given fence post 108 than any other wire 120. In addition, if more than one fence wire 120 is installed along the fence line, one or more fence stays 112 can be joined to the fence wires 120. In general, a fence stay can be used to maintain a desired spacing between fence wires 120 in areas between a brace 110 and a fence post 108, or between fence posts 108. Joining a fence stay 112 to the fence wires 120 can include placing each fence wire 120 in a different receiving aperture 116 of the fence stay 112 by receiving the wire in the respective slot portions 216, past the narrow rear portion of the slot portion 216, and back into the retaining portion 224. In accordance with further embodiments of the present disclosure, where the total vertical span of the fence wires 120 is greater than a length of an individual fence stay 112, two or more fence stays 112 can be joined to one another using one or more collars 1208 to provide a fence stay assembly 1204 with an increased effective length. Whether used singly or combined into a fence stay assembly 1204, a fence stay 112 is typically suspended above the ground 124 by the wires 120.

In accordance with the least some embodiments of the present disclosure, after placing a fence wire 120 in an aperture 116 of a fence post 108 or a fence stay 112, a grommet 1704 can be placed around the wire 120 and in the aperture 116. In particular, the wire 120 can be placed through a slot 1708 in the grommet 1704, and the grommet 1704 can then be placed in the aperture 116. A fence wire 120 can thus be secured within the retaining portion 224 of the aperture 116.

If it is determined at step 712 that no additional fence wires 120 are required along the fence line, a determination can next be made as to whether additional fence lines are desired (step 724). If additional fence lines are desired, the process can return to step 704 and one or more additional corner or H braces can be set. Otherwise, the process can end.

Embodiments of the present disclosure facilitate the construction of a wire fence 104. In particular, fence posts 108 having uniquely configured receiving apertures 116 are provided, ensuring a secure connection between fence wires 120 and the fence posts 108. Specifically, by providing relatively long receiving slot portions 216 that terminate in arced retaining portions 224, fence wires 120 can be joined to fence posts 108 quickly and easily. Moreover, the receiving aperture 116 and arced retaining portion 224 configuration, alone or in combination with a slot portion 216 that narrows from the front edge 220 of the fence post 108 toward the retaining portion 224, reduces the possibility that the fence wire 120 will become disconnected from the fence post 108. Moreover, embodiments of the present disclosure enable a wire fence 104 to be constructed without requiring the use of additional clips to hold the fence wires 120 to the fence posts 108 or fence stays 112. In addition, the arced retaining portions 224 allow for limited changes in the relative spacing between the fence wires 120. This compliance or give can promote the longevity of the fence 104. Grommets 1704 in accordance with embodiments of the present disclosure provide a fast and relatively easy way to increase the security of the attachment of a fence wire 120 to a fence post 108 or fence stay 112 when desired.

As examples, but without limitation, a metal fence post 108 in accordance with embodiments of the present disclosure can be 66 inches long, with a stem portion 204 that is one and three-quarter inches from the front edge 220 to the interface with the rear flange 208. The rear flange can have a width of one and a half inches to two inches. In embodiments in which the fence post 108 is formed from a single, rolled piece of metal, the stem portion 204 can extend for about ¾ inch from the front edge 220 to the side portions 816 and 820. The lateral sections 817 and 821 can extend for about ¾ inch from the stem portion 204, the depth portions 818 and 822 can extend for about 1 inch from the lateral sections 817 and 821, and the terminal portions 819 and 823 can be about ⅜ of an inch. In at least some embodiments, serrations or teeth 240 can be formed at 1 inch intervals in the base portion 236 of the fence post 108. At the front edge 220 of each receiving aperture 116, the corresponding slot portion 216 can have an opening or height that is 3/16 of an inch, and a height at the intersection 228 with the retaining portion 224 of less than 3/32 of an inch. The length of the slot portion 216, from the front edge 220 of the post 108 to the retaining portion 224 can be about ½ inch. The retaining portion 224 of an aperture 116 may be centered on the corresponding slot portion 216, can extend for about one half an inch from the slot portion 216, can follow a radius of curvature of about half an inch, and can have a width of ⅛ of an inch. The fence post 108 can include, for example, twenty-two receiving apertures 116, spaced at 2 inch intervals.

The foregoing description has been presented for purposes of illustration and description. Further, the description is not intended to limit the disclosure to the form disclosed herein. Consequently, variations and modifications commensurate with the above teachings, within the skill or knowledge of the relevant art, are within the scope of the present disclosure. The embodiments described hereinabove are further intended to explain the best mode presently known of practicing the disclosure and to enable others skilled in the art to utilize the disclosure in such or in other embodiments and with the various modifications required by their particular application or use of the disclosure. It is intended that the appended claims be construed to include alternative embodiments to the extent permitted by the prior art.

What is claimed is:

1. A fence post, comprising:
- a stem portion;
- a rear flange portion; and
- a plurality of receiving apertures, wherein each receiving aperture of the plurality of receiving apertures is formed in the stem portion and includes:
  - a slot portion, wherein the slot portion is open at a front edge of the stem portion and extends away from the front edge of the stem portion and toward the rear flange portion; and
  - a retaining portion, wherein the retaining portion is in communication with the slot portion,
- wherein the fence post is formed from a single piece of material,
- wherein the stem portion is interconnected to the rear flange portion by at least one bend in the single piece of material, and
- wherein the stem portion is perpendicular to the rear flange portion.

2. The fence post of claim 1, wherein the slot portion is tapered such that a top surface and a bottom surface of the slot portion are not perpendicular to the front edge of the stem portion in a side elevation view.

3. The fence post of claim 2, wherein the retaining portion is curved.

4. The fence post of claim 3, wherein the curved retaining portion is configured as an arc that is centered on the slot portion.

5. The fence post of claim 1, wherein the slot portion tapers from an opening section along the front edge of the stem portion to an end section at an interface between the slot portion and the retaining portion, wherein the opening section is wider than the end section, wherein a top surface of the slot portion describes a first straight line that extends from the front edge of the stem portion to the retaining portion, and wherein a bottom surface of the slot portion describes a second straight line that extends from the front edge of the stem portion to the retaining portion.

6. The fence post of claim 1, wherein the retaining portion includes an upper portion and a lower portion.

7. The fence post of claim 6, wherein the upper and lower portions are of equal length.

8. The fence post of claim 1, wherein the retaining portion is curved.

9. The fence post of claim 8, wherein the curved retaining portion is configured as an arc that is centered on the slot portion.

10. The fence post of claim 1, wherein the single piece of material of the fence post is a metal.

11. The fence post of claim 10, wherein the metal is steel.

12. The fence post of claim 1, wherein the single piece of material of the fence post is a composite material.

13. The fence post of claim 1, wherein the rear flange portion includes a lateral portion joined to a terminal portion by at least one contour.

14. A wire fence, comprising:
- a plurality of fence posts, each fence post being formed from a single piece of material and including:
- a stem portion;
- a rear flange portion, wherein the stem portion is interconnected to the rear flange portion by at least one bend in the single piece of material, and wherein the stem portion is perpendicular to the rear flange portion; and
- a plurality of receiving apertures, wherein each receiving aperture in the plurality of receiving apertures includes:
  - a slot portion, wherein the slot portion is open at and extends from a front edge of the stem portion and extends away from the front edge of the stem portion and toward the rear flange portion; and
  - a retaining portion, wherein the retaining portion is in communication with the slot portion; and
- a plurality of fence wires, wherein a first fence wire is received in one receiving aperture of each of the fence posts, and wherein a second fence wire is received in another receiving aperture of each of the fence posts.

15. The wire fence of claim 14, wherein the fence wires are disposed within the retaining portions of the respective receiving apertures.

16. The wire fence of claim 15, further comprising:
- a grommet, wherein the grommet is disposed around one of the fence wires and in one receiving aperture.

17. The wire fence of claim 15, further comprising: a plurality of fence stays, each fence stay including:
- a stem portion; and
- a plurality of receiving apertures, wherein each receiving aperture in the plurality of receiving apertures includes:
  - a slot portion, wherein the slot portion is open at a front edge of the stem portion and extends toward a rear edge of the stem; and
  - a retaining portion, wherein the retaining portion is in communication with the slot portion, wherein the first fence wire is received in one receiving aperture of each of the fence stays, and wherein the second fence wire is received in another receiving aperture of each of the fence stays.

18. The wire fence of claim 14, wherein each fence post in the plurality of fence posts is formed from a metal.

19. The wire fence of claim 14, wherein the rear flange portion includes a lateral portion joined to a terminal portion by at least one contour.

20. A method of constructing a wire fence, comprising:
- setting first and second braces at opposite ends of an intended fence line;
- setting a plurality of fence posts in underlaying ground along the intended fence line, wherein each fence post in the plurality of fence posts includes:
- a stem portion;

a rear flange portion; and a plurality of receiving apertures, wherein each receiving aperture of the plurality of receiving apertures is disposed in the stem portion and includes:

a slot portion, wherein the slot portion is open at a front edge of the stem portion and extends away from the front edge of the stem portion and toward the rear flange portion; and a retaining portion, wherein the retaining portion is in communication with the slot portion, wherein the fence post is formed from a single piece of material, and wherein the stem portion is interconnected to the rear flange portion by at least one bend in the single piece of material, and wherein the stem portion is perpendicular to the rear flange portion;

fixing a first fence wire to the first brace;

placing the first fence wire in one receiving aperture of each fence post in the plurality of fence posts, wherein for each fence post, the fence wire is placed in the slot portion of the one receiving aperture and then pushed into the retaining portion of the one receiving aperture; and fixing the first fence wire to the second brace.

* * * * *